United States Patent [19]

Mosse

[11] 4,332,577

[45] Jun. 1, 1982

[54] PACKAGING

[75] Inventor: Richard W. E. Mosse, London, England

[73] Assignee: Novus Corp. N.V., Curacao, Netherlands Antilles

[21] Appl. No.: 84,656

[22] Filed: Oct. 15, 1979

[30] Foreign Application Priority Data

Oct. 13, 1978 [GB] United Kingdom ..... 40547/78

[51] Int. Cl.[3] ..... B31B 1/16

[52] U.S. Cl. ..... 493/74; 229/17 G

[58] Field of Search ..... 493/74, 295; 229/17 G, 229/17 R

[56] References Cited

U.S. PATENT DOCUMENTS

| | | | |
|---|---|---|---|
| 806,230 | 12/1905 | Zahn | 229/DIG. 9 |
| 1,143,745 | 6/1915 | Bloomer | 229/DIG. 9 |
| 1,253,436 | 1/1918 | Smith | 229/17 R |
| 1,882,133 | 10/1932 | Fischer | 229/DIG. 9 |
| 2,185,544 | 1/1940 | Darragh | 229/DIG. 9 |
| 2,272,203 | 2/1942 | Hothersull | 229/17 R |
| 2,363,425 | 11/1944 | Klein | 229/DIG. 9 |
| 2,581,237 | 1/1952 | Casler | 229/DIG. 9 |
| 2,661,138 | 12/1953 | Leonard | 229/17 G |
| 2,775,388 | 12/1956 | Nerenberg | 229/17 R |
| 3,270,940 | 9/1966 | Egleston et al. | 229/17 G |
| 3,365,115 | 1/1968 | Pike | 229/17 R |
| 3,389,849 | 6/1968 | Egleston | 229/17 G |
| 4,192,446 | 3/1980 | Naito | 229/17 G |

FOREIGN PATENT DOCUMENTS

| | | | |
|---|---|---|---|
| 898609 | 6/1962 | United Kingdom | 229/17 G |

*Primary Examiner*—Stephen P. Garbe

*Attorney, Agent, or Firm*—Wegner, McCord, Wood & Dalton

[57] ABSTRACT

A gable-topped, flat-bottomed carton has a side seam which, in a fin of the gable top closure, fits in a gap between respective junctions of two pairs of internal sub-panels of the fin. Two opposite external sub-panels of the fin have tabs for pulling to open the closure to form a spout. The seam edge of one oblique sealing sub-panel of the closure has a tab, with scorelines from the tab into that sub-panel, while the seam edge of the other oblique sealing sub-panel has a corresponding recess covered by the one oblique sealing sub-panel, so that pulling of the tab tears back the sub-panel portion between the scorelines to expose the recess. The flat bottom closure has at the free edge of its widest sub-panel a sealing projection of a width of about one third of that of the sub-panel to facilitate interdigitation of the blanks.

6 Claims, 4 Drawing Figures

PACKAGING

FIELD OF THE INVENTION

This invention relates to packaging, and is particularly applicable to gable-topped cartons as employed in the packing of liquids, such as milk or fruit juice, to be sold retail.

DESCRIPTION OF THE PRIOR ART

Gable-topped, flat-bottomed cartons are generally of rectangular-section and formed from a blank of paperboard coated on both sides with a thermoplastic. The blank is divided by score lines into five panels in a row themselves divided by other score lines into sub-panels. The blank is made into a rectangular-section packing sleeve by folding the panels about the first-mentioned score lines and adhering the two end panels of the blank to each other to form a seam extending along the sleeve. The sleeve is formed with a flat bottom closure and a gable top closure. The flat-bottom closure consists generally of two horizontal opposed rectangular flaps, two horizontal opposed triangular flaps arranged inwardly of the rectangular flaps, and four horizontal triangular fold-back gussets integral with the triangular and rectangular flaps. The rectangular flaps overlap each other, and also are there heat-sealed together, over substantially the whole of their widths. The gable-top closure consists generally of two opposed rectangular flaps inclined upwardly to make the gable formation, two opposed triangular flaps inclined upwardly between the rectangular flaps, and four triangular fold-back gussets integral with the rectangular and triangular flaps and lying against the undersides of the rectangular flaps. The rectangular flaps and the gussets extend upwardly as approximately rectangular sub-panels which are heat-sealed together to form a vertical fin along the top of the gable.

Problems with such a conventional carton are that the large variation in the number of thicknesses of material along the fin can cause the heated clamping jaws used for heat-sealing together the sub-panels to form the fin to fail to produce a fluid-tight seal at the fin, with a consequential leakage of the liquid from the carton; that the gable-top closure is difficult to open correctly, particularly in a case where the rectangular flaps are formed with respective oblique score-lines to permit one of the triangular flaps to be swung outwardly with the two adjacent gussets swinging outwardly through dead-centre, to form a pouring spout; and that, owing to the size and shape of the sub-panels forming the top and bottom closures, there is a significant amount of waste material remaining following die-cutting of the blanks.

There is known from Swedish Pat. No. 398,095 a gable-topped, flat-bottomed carton of which the gable top closure includes a fin which is of increased height over about half of its length to form a projecting lug which is folded over and outside-sealed to the top of the carton, thus forming a flat-top configuration. The lug provides a larger area for the consumer to grasp during opening the carton by tearing.

U.S. Pat. No. 2,959,336 discloses a carton which has been made from a rectangular blank and which is flat-bottomed and possibly gable-topped, each of these closures being formed with a fin, and the seam of the carton extending along the centre of one side of the carton. The carton consists of a thermoplastic lining on a cardboard or like sheet, and most of the sub-panels of each fin consist of the lining and not the sheet.

U.S. Pat. No. 3,355,083 discloses a gable-topped carton which has been made from a rectangular blank and wherein either one of the rectangular flaps, or the two qussets and the triangular flap at one end of the gable, are formed with a zig-zag line of incisions closed by a tape and providing a pouring mouth. The ends of the tape protrude beyond edges of the gable-top closure for grasping to facilitate stripping of the tape from the line of incisions. In the fin, the inner ends of the gusset sub-panels are supposed to abut each other to prevent leakage of liquid, but this is still liable to occur, because manufacturing tolerances militate against achievement of a good sealing abutment. The seam of the carton extends centrally of one side of the carton and lies against the inner ends of these gusset sub-panels.

One of the objects of the invention is to improve the reliability of the heat-sealing of a fin of an end closure of a carton. Another object is to facilitate correct opening of a pouring spout of a gable-top closure of a carton. A further object is to reduce the proportion of waste material produced during die-cutting of a carton blank. An additional object is to provide a sealed straw-hole for a carton in a simple and cheap manner.

SUMMARY OF THE INVENTION

According to one aspect of the present invention, there is provided a carton including an end closure comprised of a loop of sub-panels integral with one another, the loop including second and third sub-panels turned inwards of a sealing first sub-panel and a fourth sub-panel, respectively, of the loop, and fifth and sixth sub-panels turned inwards of said fourth sub-panel and a sealing seventh sub-panel, respectively, of the loop, the first and seventh sub-panels being sealed to each other and over-lapping each other in such a manner that, in a fully closed condition of said end closure in which the sub-panels extend substantially parallel to one another, the overlap is substantially fittingly received in a gap between the second and third sub-panels, on the one hand, and the fifth and sixth sub-panels, on the other hand.

This arrangement has the advantage that the thickness of the fin formed by the loop need vary only between three and four thicknesses of the carton material, so that heat-sealing jaws applied to the fin can reliably produce a good seal at the fin.

According to another aspect of the present invention, there is provided a carton including an end closure comprised of a loop of sub-panels integral with one another, the loop including external first and fourth sub-panels, internal second and third sub-panels, and internal fifth and sixth sub-panels all extending substantially parallel to one another and each sealed to at least one other sub-panel of the loop to seal the end closure, sub-panels of the loop at respective opposite sides of a plane containing the contact surface between the second and third sub-panels and also the contact surface between the fifth and sixth sub-panels having parts projecting therefrom for a person to take hold of and pull away from each other to open the end closure.

This arrangement facilitates opening of the end closure by a consumer.

According to a further aspect of the present invention, there is provided a carton blank comprising a row of five panels which are integral with one another and which in the carton form side walls and end closures of the carton, two of the panels separated from each other by a further one of the panels being of the same dimension as each other along said row but having that dimension smaller than the dimension along said row of said further one of the panels, one of those two edges of said blank extending along said row being formed at the locations of said two of the panels with respective recesses each extending not only over the dimension along said row of its associated panel but also over part of the dimension along said row of said further one of said panels, thereby leaving as a projection of said further one of said panels a lug of a dimension along said row significantly less than that of said further one of said panels.

According to a yet further aspect of the present invention, there is provided a method of producing carton blanks, comprising cutting from a sheet a first carton blank having a row of five panels of which alternate panels include respective projections at an edge of the first blank extending along said row, and cutting from said sheet a second carton blank having a parallel row of five panels of which alternate panels have at an edge of the second blank extending along the row of said second blank respective projections interdigitating with the projections of the first blank, the projection of one of the panels of the first blank having a dimension along said row of said first blank significantly smaller than that of said one of the panels, and one of said projections of the second blank being at least partly co-extensive along the rows with said one of the panels of the first blank.

These latter aspects of the invention have the advantage of permitting the attainment of a minimal amount of waste of carton material during die-cutting of carton blanks.

According to an additional aspect of the present invention, there is provided a carton including two panels which overlap each other and are sealed together at the overlap to provide a liquid-tight seam, a tab projecting from the outer panel at that free edge of the outer panel extending along the seam, and a straw-hole through the inner panel which can be exposed by pulling the tab to tear back a portion of the outer panel covering the hole.

This arrangement is a simple and cheap way of providing a sealed straw-hole in a carton.

BRIEF DESCRIPTION OF THE DRAWINGS

In order that the invention may be clearly understood and readily carried into effect, reference will now be made, by way of example, to the accompanying drawings, in which.

DESCRIPTION OF THE PREFERRED EMBODIMENT

Figure 1:
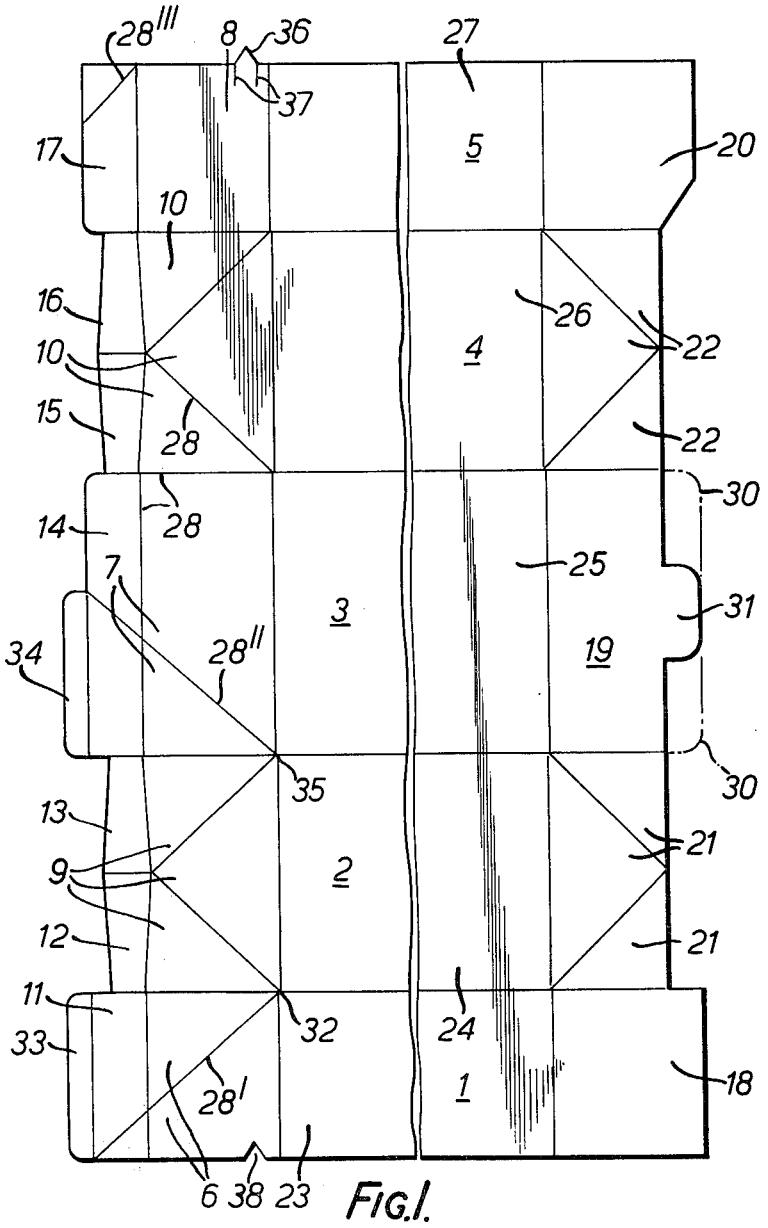
FIG. 1 shows a fragmentary plan view of a carton blank from which a gable-topped, flat-bottomed carton is to be formed.

Referring to FIG. 1, the blank consists of five panels 1 to 5 arranged one after another in a row and is formed of suitable card-like sheet material. It has been cut from a strip of the sheet material along with a number of identical blanks. Along one edge of the blank is a line of first to seventh sub-panels 11 to 17, of which the sub-panels 11, 14 and 17 form parts of the panels 1, 3 and 5, respectively, and the pairs of sub-panels 12 and 13, and 15 and 16, form parts of the panels 2 and 4, respectively. Inwardly of the sub-panels 11, 14 and 17 are arranged sub-panels 6, 7 and 8, whereas inwardly of the sub-panel pairs 12 and 13, and 15 and 16, are arranged sub-panels 9 and 10. Along the opposite longitudinal edge of the blank, the panels 1, 3 and 5 include respective basically rectangular sub-panels 18, 19 and 20, whilst the panels 2 and 4 include triangular sub-panels 21 and 22. Arranged between the sub-panels 6 to 10, on the one hand, and the sub-panels 18 to 22, on the other hand, are rectangular sub-panels 23 to 27. The sub-panels 6 to 27 are interconnected by way of lines of weakness in the form of score lines 28. It will be readily appreciated that the sub-panels 6 to 17 provide the top end closure, the sub-panels 18 to 22 the bottom end closure, and the sub-panels 23 to 27 the side walls, of the gable-topped, flat-bottomed carton. From the intersection 32 of some of the score lines 28, a score line 28' of the score lines 28 extends to the opposite corner of the sub-panel 11, from which projects, for the length of the sub-panel, a tab 33. A tab 34 of the same size and shape as the tab 33 extends part way along the sub-panel 14 from that end of the sub-panel nearer the sub-panel 11. A score line 28'' extends from that end of the tab 34 further from the sub-panel 11 to the intersection 35 of some of the score lines 28. A score line 28''' extends across the sub-panel 17 at the same angle to the row of panels 1 to 5 as does the score line 28' and from the adjacent end edge of the blank. A triangular tab 36 projects from the free edge of the sub-panel 8, two score lines 37 extending from the ends of the base of the tab 36 into the sub-panel 8. The die-cutting of the tab 36 leaves a complementary triangular notch in the immediately preceding blank, the blank shown in FIG. 1 therefore also having such complementary triangular notch 38 formed in the free edge of its sub-panels 6.

Figure 2:
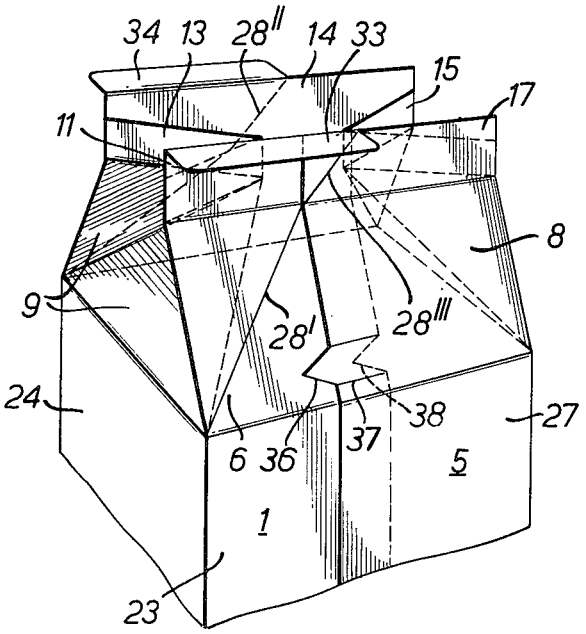
FIG. 2 shows a perspective view of the top end closure of the carton in a partly closed condition.

Referring to FIG. 2, it will be noted that the panels 1 and 5 overlap each other, these panels being sealed together at this overlap, for example by means of heat-sealing in the case of plastics-surfaced sheet material.

Figure 3:
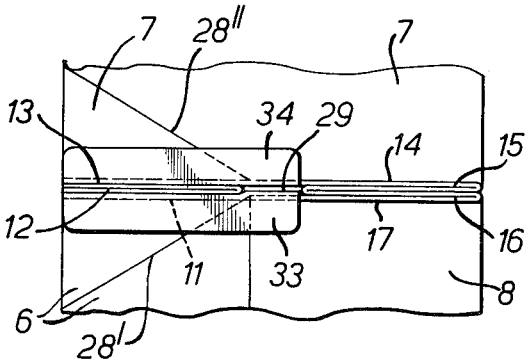
FIG. 3 shows a fragmentary top plan view of the top end closure in a fully closed condition.

Referring to FIG. 3, the carton blank has been so designed that, when the top end closure is fully closed so that the sub-panels of the loop of sub-panels 11 to 17 are located parallel and face-to-face with respect to one another, the overlap 29 between the sub-panels 11 and 17 is fittingly received in a gap between the sub-panels 12 and 13, on the one hand, and the sub-panels 15 and 16, on the other hand. This has the advantage of giving a more leak-free gable top than with a conventional gable-topped carton in which the panel overlap is positioned at a corner of the carton. With such a conventional carton, the number of layers of sheet material in the ridge of the gable top varies from five at one end of the ridge to two at the centre of the ridge. This degree of variation makes it difficult for the conventional flat-faced sealing jaws applied to respective opposite faces of the ridge to apply a sufficiently good sealing pressure at all locations along the ridge. However, with the present ridge shown in FIG. 3, the number of layers of sheet material varies only between four along most of the ridge and three along a central part of the ridge. This clearly improves the effectiveness of the sealing jaws.

The provision of the tabs 33 and 34, which project laterally from the sealed end closure, as seen in FIG. 3, enables the consumer more easily to open the end closure. The consumer takes hold of the tabs 33 and 34 between the thumbs and forefingers of his respective hands and pulls the tabs away from each other, swinging them about their inner ends which are in fact in the region of the junction between the sub-panels 15 and 16. The score lines 28' and 28'' and 28''' allow those sub-panels 6 and 7 to the left of these score lines in FIG. 3 to swing about these score lines and thus produce on the sub-panels 12 and 13 a form of toggle action which pulls the junction of these sub-panels 12 and 13 away from the sub-panels 15 and 16, thereby reliably to break the seal between this junction and the sub-panels 11 and 14, whereafter this junction can be passed through its dead-centre position to protrude from one end of the carton so that the sub-panels 9, 12 and 13 form a pouring spout.

Figure 4:
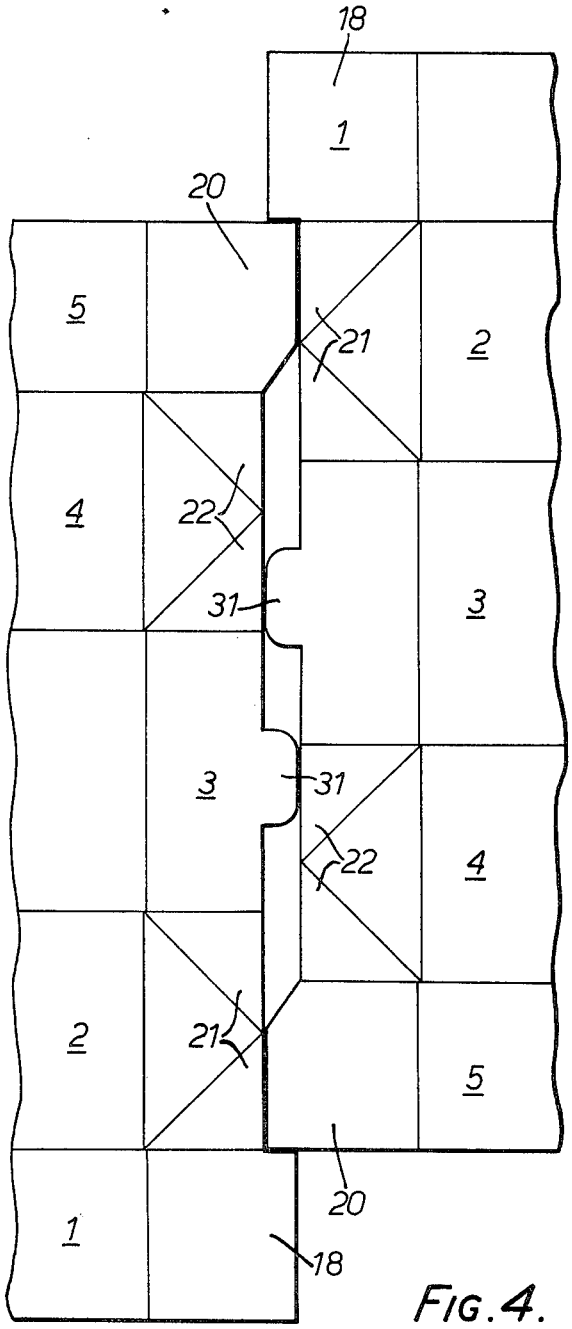
FIG. 4 shows a fragmentary plan view of two carton blanks each identical to the blank shown in FIG. 1, and illustrates interdigitation of the blanks.

The arrangement of the sub-panels 18 to 22 shown, but with the sub-panel 19 extended to the chain lines 30, is conventional for a flat end closure. It will be appreciated that with such a conventional arrangement of sub-panels, if, as shown, the panel 3 is longer in the direction of the row of panels 1 to 5 than the panels 2 and 4, which are of course of equal length, one cannot arrange for the projections from the longitudinal edge of the blank to interdigitate with the projections from either longitudinal edge of another, identical blank, since the projection from the panel 3, which projection is indicated by the chain lines 30, is too long to be received in either recess in that longitudinal edge corresponding to the panel 2 or 4. Therefore, the amount of waste sheet material produced in cutting a given number of blanks from the strip of sheet material is greater than it would be if the projections were to interdigitate. In order to allow this to take place in the manner illustrated in FIG. 4, the sub-panel 19 comprises a projection 31 the dimension of which along the row of panels is only about one third of that of the panel 3. The omission of the portions of the sub-panel 19 between the projection 31 and the chain lines 30 is not disadvantageous as regards leak-free sealing of the bottom end closure, because those portions are not in practice exposed to the substance in the carton and thus do not need to perform any sealing function.

During formation of the seam between the panels 1 and 5, the panel 5 covers the notch 38 from the outside, the tab 36 not itself being heat-sealed to the panel 1. Subsequent pulling on the tab 36 by a consumer causes the portion of the panel 5 between the score lines 37 to be torn back to expose the notch 38 to permit a drinking straw to be inserted by the consumer.

I claim:

1. A method of producing carton blanks, comprising cutting from a sheet a first carton blank having a row of five panels of which alternate panels include respective projections at an edge of the first blank extending along said row, and cutting from said sheet a second carton blank having a parallel row of five panels of which the panels are offset along the row of said second blank relative to corresponding panels of the row of said first blank and of which alternate panels have at an edge of the second blank extending along the row of said second blank respective projections in an arrangement substantially identical to that of the first-mentioned projections and interdigitating with those projections, the projection of one of the panels of the first blank having a dimension along said row of said first blank significantly smaller than that of said one of the panels, and one of said projections of the second blank being at least partly co-extensive along the rows with said one of the panels of the first blank.

2. A method of providing blanks according to claim 1 wherein each of said projections has a dimension along said row of said first blank of about one-third of that of said one of the panels of the first blank.

3. A method according to claim 1, wherein said projection of said one of the panels of said first blank has a dimension along said row of said first blank of about one-third of that of said one of the panels of the first blank.

4. A carton blank formed by the method of claim 1.

5. A method of producing carton blanks, comprising the steps of:

cutting from a sheet a first carton blank having a row of at least three panels of which a middle panel includes a projection at an edge of the first blank extending along said row; and cutting from said sheet a second carton blank having a parallel row of panels of which the panels are offset along the row of said second blank relative to corresponding panels of the row of said first blank and of which a middle panel has at an edge of the second blank extending along the row of said second blank a projection interdigitating with said edge of the first blank, each of said projections having a dimension along said rows of said blanks smaller than that of said middle panel of its blank, and each of said projectings being at least partly coextensive along the rows with said middle panel of the other blank.

6. A method of providing blanks according to claim 5 wherein said projections have a dimension along said row of said first blank of about one-third of that of said middle panel of its blank.

* * * * *